US007166344B2

(12) United States Patent
Dean

(10) Patent No.: US 7,166,344 B2
(45) Date of Patent: Jan. 23, 2007

(54) DUST-FREE SEALER FOR VALVE BAGS

(76) Inventor: James Dean, 20323 Quincy Ct., Humble, TX (US) 77338

( * ) Notice: Subject to any disclaimer, the term of this patent is extended or adjusted under 35 U.S.C. 154(b) by 326 days.

(21) Appl. No.: 10/360,165

(22) Filed: Feb. 6, 2003

(65) Prior Publication Data

US 2003/0194153 A1 Oct. 16, 2003

Related U.S. Application Data

(60) Provisional application No. 60/371,870, filed on Apr. 11, 2002.

(51) Int. Cl.
*B32B 3/00* (2006.01)

(52) U.S. Cl. ..... 428/40.1; 428/41.7; 428/41.9; 428/43; 428/192; 428/194; 428/200; 428/201; 428/202

(58) Field of Classification Search ..... 428/40.1, 428/41.9, 43, 192, 194, 41.7, 200, 201, 202
See application file for complete search history.

(56) References Cited

U.S. PATENT DOCUMENTS

| | | | | | |
|---|---|---|---|---|---|
| 3,869,333 | A | * | 3/1975 | McMaster | 428/56 |
| 4,003,188 | A | | 1/1977 | Lau | |
| 4,073,429 | A | | 2/1978 | Lawes | |
| 4,688,370 | A | | 8/1987 | Gighton et al. | |
| 5,620,542 | A | | 4/1997 | Avila et al. | |
| 6,092,930 | A | | 7/2000 | Kelly et al. | |
| 6,126,316 | A | | 10/2000 | Bannister | |
| 6,164,823 | A | | 12/2000 | Donnell | |
| 6,649,239 | B1 | * | 11/2003 | Donahue | 428/40.1 |

* cited by examiner

*Primary Examiner*—Nasser Ahmad
(74) *Attorney, Agent, or Firm*—Elizabeth R. Hall

(57) ABSTRACT

The invention provides for a sealing device for a valve bag. The sealing device has two sections separated by a perforated seam. Each section is secured to one side of the valve channel and has an adhesive surface covered by a protective sheet. The two sections are perforated by the filling tube when the valve bag is filled, once the valve bag is filled the protective sheet is cleaned and removed and the two sections of the sealing device are pressed together and secured by the interaction of their adhesive surfaces.

12 Claims, 9 Drawing Sheets

DUST-FREE SEALER FOR VALVE BAGS

CROSS REFERENCE TO RELATED APPLICATIONS

This application claims priority to the following patent application: pending U.S. patent application Ser. No. 60/371,870 filed Apr. 11, 2002 by inventor James Dean and entitled "Dust-free Sealer for Valve Bags."

BACKGROUND OF THE INVENTION

1. Field of the Invention

The present invention relates generally to valve bags and, more specifically to a mechanism for sealing a valve bag used to contain and transport fine granular products (e.g., rice hull ash) to prevent loss of the products from the valve bag during the handling and shipping of filled valve bags.

2. Description of the Related Art

Plastic valve bags are multi-walled sacks made of a flexible plastic material. Typically, valve bags are formed by cutting and overlapping each layer of plastic along its length. The overlapping region on the long side of the bag is heat sealed, as well as the short sides or ends; provided that a portion of the long side is left unsealed close to one end of the bag to provide a fill hole or valve channel. Alternatively, the valve channel may be configured along the short side of the bag.

Valve bags are filled through a filling tube inserted into the valve channel. Once the valve bag is filled, the bag is upended so that the weight of the filling material closes the valve channel. However, some of the filling material escapes through the unsealed valve channel whenever the valve sack is being handled. For example, the filling material will seep out of the unsealed valve channel during transport so that the filling material is deposited between the layers of bags in a container. When the consumer seeks to remove the filled valve bags from the shipping container, the loose filling material gets into workers' eyes generating a source of eye irritation. To prevent worker health problems and lost time due to eye irritation, a number of attempts have been made to find a suitable sealing mechanism for valve bags to prevent the sieving or leakage of the bag contents back through the valve channel after filling. Typically, these mechanisms have included coating the inner surfaces of the overlapping valve channel with an adhesive or other sealing material, which may be activated by heat or ultrasonic means. Recently, attempts have been made to construct a valve bag sleeve such as described in U.S. Pat. No. 6,164,823 or a self-closing bag such as described in U.S. Pat. No. 6,126,316 to address this problem.

Although some of the sieving problems have been prevented by these various sealing methods, the current sealing mechanisms are not effective in a number of situations or are inapplicable to many mechanical bag-filling systems. Sieving problems are accentuated in the case of filling materials such as rice hull ash.

Harvested paddy rice is subjected to processing operations that remove the rice hulls from the paddy rice. A major use of the separated rice hulls is as a fuel source. Burning rice hulls releases a great deal of energy and renders fine amorphous $SiO_2$ or black dust particles called rice hull ash. These dust particles are primarily composed of silica and contain considerable air space within its interstices, thereby producing a remarkably insulative material often used to insulate molten steel.

Typically, rice hull ash is packaged, sold and transported in plastic valve bags. To date there has been no successful mechanism for sealing valve bags containing rice hull ash during their transport. One problem is that once a bag is filled on the fill tube and is removed, the fill tube drags particles of the rice hull ash along with it across the ends of the valve channel contaminating the opposing surfaces, thereby preventing a tight seal when the adhesive on the opposing surfaces is activated. This is a particular problem if the adhesive is to be activated by heat, since the rice hull ash has particularly strong insulative properties.

Thus, there is an existing need to securely seal a valve bag filled with minute particles having insulative properties. Since filling of the valve bag typically contaminates the sides of the valve channel with the particles with which the valve bag is filled, a protection means is needed that will protect the surfaces of the valve channel during the filling of the bag to ensure the secure sealing of the valve channel once the valve bag has been filled and flattened.

SUMMARY OF THE INVENTION

One aspect of the invention provides for a sealing device comprising a sheet of flexible material having a first section and a second section at opposed ends of the sheet, wherein the sheet is sufficiently flexible such that the first section is foldable over the second section; a first adhesive underlying at least one section of the sheet; a second adhesive on an upper surface of at least one section of the sheet; and a removable upper protective sheet covering the second adhesive.

Another aspect of the invention provides for a sealing device comprising two inside sections having a first adhesive coating an inner surface of the inside sections; two outside sections having a second adhesive coating an outer surface of said outer sections; and a removable protective sheet covering the adhesive coating of said outer surface of said outer sections.

Yet another aspect of the invention provides for a valve bag having a tubular body and a valve channel, wherein the improvement includes a sealing device comprising: a sheet of flexible material having a first section and a second section at opposed ends of the sheet, wherein the sheet is sufficiently flexible such that the first section is foldable over the second section; a first adhesive underlying the sheet, such adhesive securing the backside of the first section to an underside of a top side of the valve channel and the backside of the second section to the upper side of the bottom side of the valve channel; a perforated seam located between the first section and the second section of the sheet and substantially centered in the valve channel; a second adhesive overlaying an upper surface of the first and second sections of the sheet; and a removable upper protective sheet covering the second adhesive; whereby when the protective sheet is removed from the second adhesive on the upper surface of the first and second sections, the top side of the first section is folded over the top side of the second section of the sheet and the first and second sections are pressed together such that the valve channel is sealed by the interaction between the second adhesive on the upper surface of the first section with the second adhesive on second section.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed might be readily utilized as a basis for modifying or designing other structures for carrying out the same purpose of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 18 is an exploded view of a valve bag;

DESCRIPTION OF THE PREFERRED EMBODIMENTS

The present invention relates to the manufacture, installation and use of a sealing device for sealing a valve channel of a valve bag; particularly a valve bag filled with minute particles having insulative properties that negate the heat sealing of the valve channel.

Figure 1:
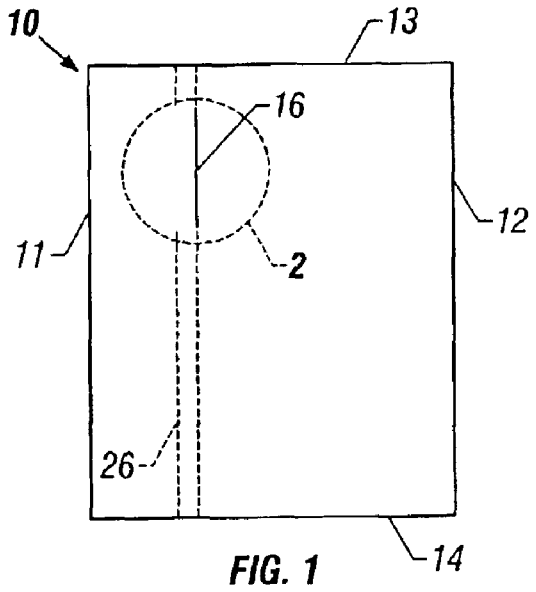
FIG. 1 is a side view of a valve bag having a side channel.

Referring now to the drawings, and initially to FIG. 1, it is emphasized that the Figures, or drawings, are not intended to be to scale. For example, purely for the sake of greater clarity in the drawings, layer thicknesses and spacings are not dimensioned as they actually exist in the assembled embodiments.

A typical valve bag 10 has a tubular configuration with long sides 11 and 12 and short sides 13 and 14 as shown in FIG. 1. Valve bags are preferably multi-walled, for example having 2 to 4 layers. For simplicity, however, the valve bag 10 is depicted in the Figures as being made from only a single layer of plastic. The valve bag 10 is generally formed by cutting and overlapping a layer of plastic along its length. The overlapping region on the long side of the bag is heat sealed, as well as the short sides 13 and 14; provided that a portion of one side is left unsealed close to one end of the bag to provide a fill hole or side valve channel 16.

Figure 2:
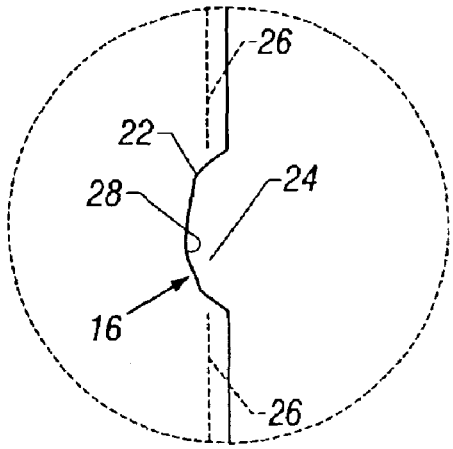
FIG. 2 is a pan view of a valve channel.

A side valve channel 16 is shown in more detail in FIG. 2. The valve channel 16 is defined between the overlapping front flap 22 and the bottom flap 24. The valve channel 16 is not heat sealed whereas the rest of the seam along the length of the valve bag 10 has been heat sealed along heat seam 26. The valve channel 16 allows introduction of the product (not shown) that is to be held within the valve bag 10. The valve channel is disposed close to the short side 13 of the valve bag 10, but is preferably about 2 to about 6 inches below the intersection of the heat seam 26 and the short side 13.

Figure 18:
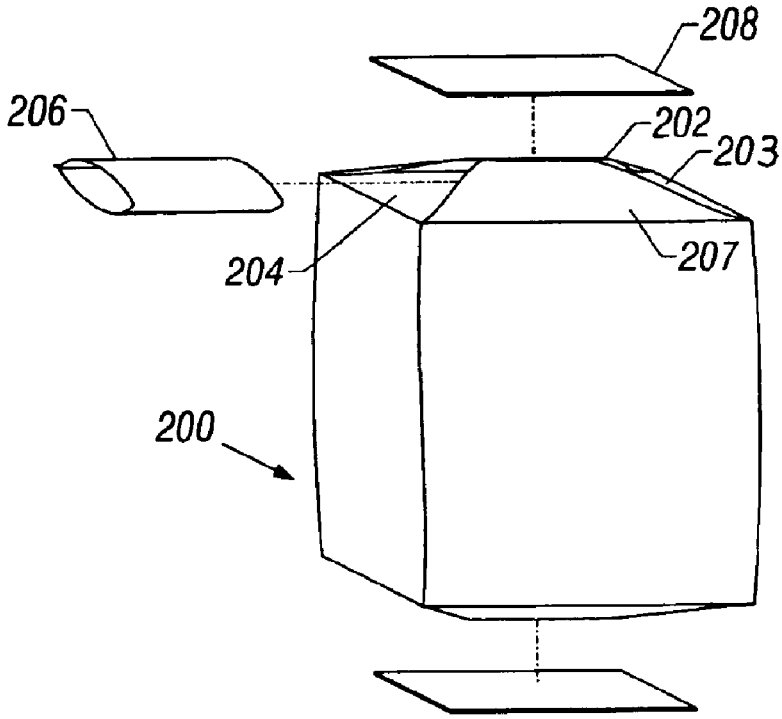

An alternative configuration of a valve bag 200 is shown in FIG. 18. The valve bag 200 is typically made of one or more layers of paper or plastic. Typically the short sides 204 and 203 of the ends of the valve bag 200 are folded towards the center of the valve bag 200. Then a tubular valve channel 206 is secured to one of the folded short sides such that one end of the valve channel 206 is in communication with the interior of the valve bag 200 and an opposed end of the valve channel 206 is open to the exterior of the valve bag 200. The long sides 202 and 207 of the ends are then folded over the short sides 204 and 203 and the valve channel 206. Finally, a top overlay piece 208 is added to secure the ends of the valve bag 200. Generally the interacting sections of the ends of the valve bag 200 are heat sealed together, except that the interior of the tubular valve channel 206 is left open so that a filling tube can be introduced into the exterior end of the valve channel 206 and introduce product into the interior of the valve bag 200.

The present invention provides for a means of securely sealing a valve channel 16 or 206 of a valve bag 10 or 200 filled with minute insulative particles. The present invention prevents the contamination of the adhesive on the sides of the valve channel 16 or 206 with the particles filling the valve bag 10 or 200 by protecting at least one adhesive layer of the sealing device during the filling and flattening of the valve bag 10 or 200.

One embodiment of the present invention provides a sealing device having two sections separated by a perforated seam. Each section is secured to one side of the valve channel and has an adhesive surface covered by a protective sheet. The two sections are perforated by the filling tube when the filling tube is inserted into the valve bag 10 to fill the valve bag. Once the valve bag 10 is filled and the fill tube removed, the protective sheet, covering the adhesive layer on each section of the sealing device, is cleaned and removed and the two sections of the sealing device are pressed together and secured by the interaction of their adhesive layers.

A preferred embodiment of the valve sealing device of the present invention is designed to fit into existing 6 inch valve channels situated along seam 26 of double walled 3.5-mil thick plastic valve bags. However, the sealing device may be varied in size and shape to fit into various types of valve bags. The sealing device is typically incorporated into the valve channel 16 as the plastic film is being formed into the valve bag 10 as described below, or into the valve channel 206 as it is being formed. Several embodiments of the sealing device of the present invention are described in the illustrative examples below.

EXAMPLE 1

Internal-External Sealing Device

Figure 3A:
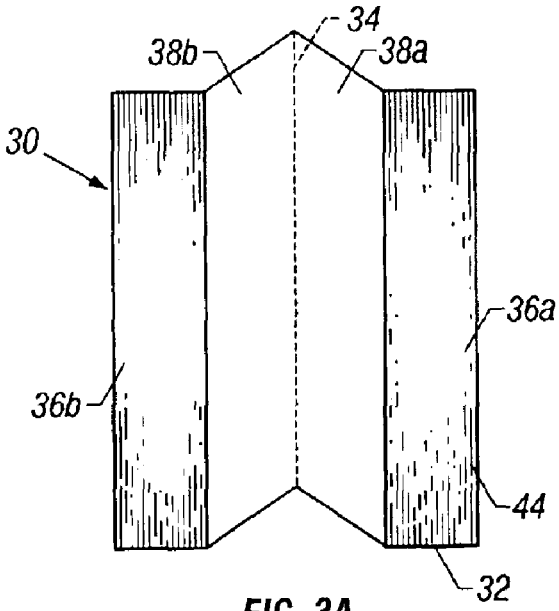
FIG. 3A is a front pan view of one embodiment of the sealing device according to the present invention.
Figure 4A:
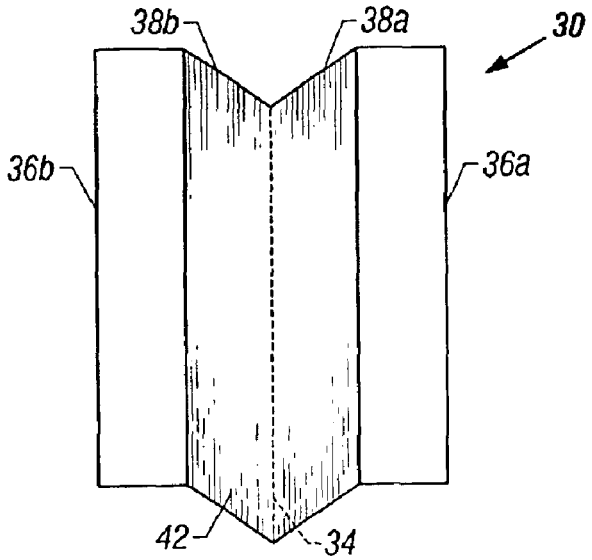
FIG. 4A is a back pan view of the sealing device shown in FIG. 3A.

One embodiment of the sealing device of the present invention is illustrated in FIGS. 3A and 4A. The sealing device 30, illustrated in FIG. 3A, is made from a piece of soft plastic (preferably polypropylene or polyethylene) or paper approximately 7 inches high and 8 inches wide. The plastic or paper piece is folded in half widthwise and the fold is perforated to tear when pushed against by a fill tube. Then each half is folded outward back on itself to the perforated seam 34. The folded sealing device 30 has two outside sections 36*a* and 36*b* and two inside sections 38*a* and 38*b*.

Figure 3B:
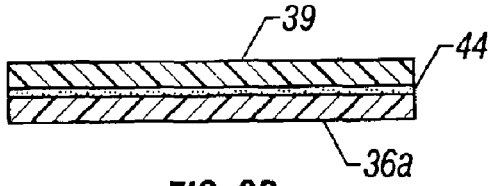
FIG. 3B is a cross sectional view of the outside section of the sealing device shown in FIG. 3A.
Figure 4B:
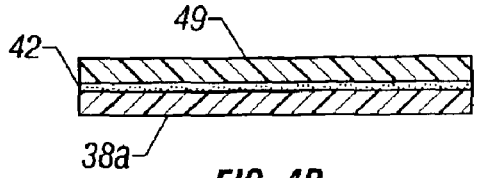
FIG. 4B is a cross sectional view of the inside section of the sealing device shown in FIG. 4A.

FIG. 3A is a frontal view of sealing device 30 as it fits into valve bag 10, whereas FIG. 4A is a backside view of the sealing device 30. The back surface of the two inside sections 38*a* and 38*b* will have an adhesive 42 applied to them as shown in FIGS. 4A and 4B. Likewise, the front surface of the two outside sections 36*a* and 36*b* will have an adhesive 44 applied to them as shown in FIGS. 3A and 3B. To protect the adhesive before its application to the point of desired contact, removable strips of protective material 39 are placed over the adhesive 44 on the front surface of the outside sections 36*a* and 36*b* as illustrated in FIG. 3B. Similar removable strips of protective material 49 are optionally placed over the adhesive 42 on the back surface of the two inside sections 38*a* and 38*b* as shown in FIG. 4B. Preferably, the adhesive 42 is a heat activated adhesive that is activated to adhere to the sides of the valve channel 16 during the heat sealing of the long side of the valve bag 10. If the adhesive 42 is heat activated, it will not need to be protected with protective material 49.

When the sealing device is installed into the valve channel 16, the adhesive 42 of the inside sections 38*a* and 38*b* is contacted with and adhered to the inside surface 28 of the front flap 22 and the top surface of the bottom flap 24 respectively. The adherence of the inside sections to the sides of the valve channel 16 is accomplished by a variety of means known in the art such as glue or a heat activated adhesive.

Once the inside surfaces 38*a* and 38*b* of the sealing device 30 have been adhered to the inside surface 28 of the front flap 22 and the top surface of the bottom flap 24, the perforated seam 34 is in about the middle of the valve channel 16 and the front surface of the outside sections 36*a* and 36*b* extends beyond front flap 22 and bottom flap 24 respectively. The adhesive 44 on the front surface of the outside sections 36*a* and 36*b* is protected with removable protective strips 39.

Figure 5:
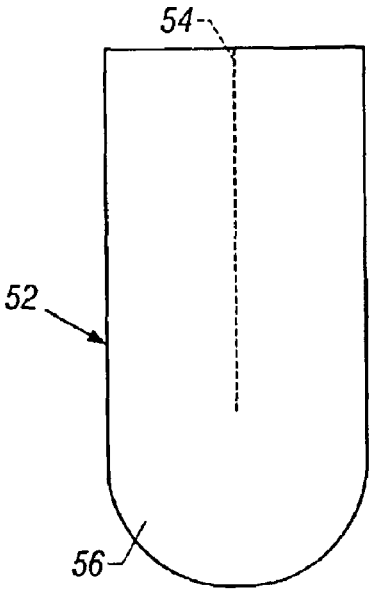
FIG. 5 is a front view of a sheet of protective material.

When the sealing device 30 is installed in the valve channel 16 as described above, the outside sections 36*a* and 36*b* will abut each other. The adhesive 44 on the outside sections 36*a* and 36*b* is preferably protected by a single sheet of protective material 52, shown in FIG. 5, having a perforated seam 54 in the middle the protective sheet 52. When the fill tube is pushed through the perforated seam 54 to begin filling the valve bag 10, the protective sheet 52 will either split into two halves or it will stay adjoined at the lower end 56. The protective sheet 52 may be designed to remain a single piece at the lower end 56 by extending the protective sheet 52 beyond the length of the valve channel sufficiently to allow the entrance of the fill tube into the valve channel 16 without splitting the bottom of the protective sheet 52. In addition, the lower end 56 is not perforated to further encourage the protective sheet 52 not to split at its bottom end when the fill tube is pushed into the valve channel 16 and through perforation 34 of the sealing device 30 to begin filling the valve bag 10.

Figure 6:
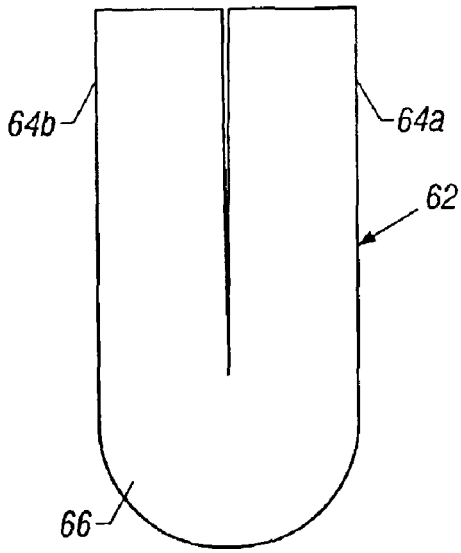
FIG. 6 is a front view of another embodiment of a sheet of protective material.

Another embodiment of the protective sheet 62, shown in FIG. 6, will be cut at one end to form two strips of protective material 64*a* and 64*b* at its upper, while the lower end 66 will be a single piece. Thus, the protective sheet 62 will have a Y-like shape with the strips of protective material 64*a* and 64*b* being applied to the outside sections 36*a* and 36*b* respectively. Thus, the protective sheet 62 is removable in one movement by pulling upward on the bottom end 66.

Once the protective sheet 52 or 62 is removed from the outside sections 36*a* and 36*b*, the outside sections are folded over each other and pressed together to form a consistent secure seal for the valve channel 16. The width of the outside sections 36*a* and 36*b*, as well as the strips of protective material 64*a* and 64*b*, must be sufficient to ensure enough adhesive covered surface area is available to securely seal the valve channel 16, even if the outside sections do not exactly align after the valve bag 10 is filled.

Valve bags 10 manufactured with the sealing device 30 in place are easily filled and sealed on the typical assembly line. The valve bags 10 are filled through a filling tube inserted into the valve channel 16. Once the valve bag 10 is filled, the valve bag 10 is flattened to remove excess air, particles and dust are blown or wiped from the surface of the protective sheet 52 or 62 covering the outside sections 36*a* and 36*b*, the protective sheet 52 or 62 is removed, and the outside sections 36*a* and 36*b* are folded over on top of each other and sealed by pressing down on the adhesive layers. Once sealed, the valve channel 16 will not leak the filling material during handling or transport.

EXAMPLE 2

Overlapping Valve Channel Sealing Device

Figure 7:
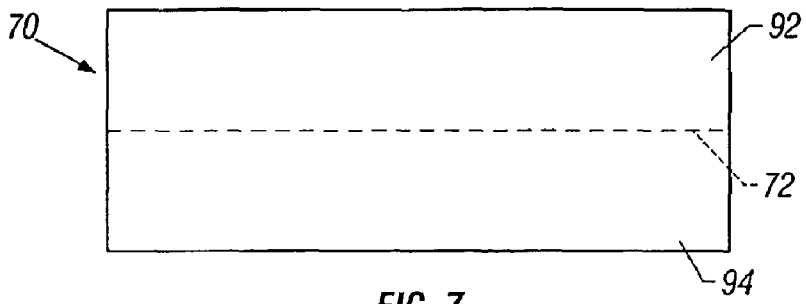
FIG. 7 is a frontal view of another embodiment of the present invention.

A second embodiment of the present invention is illustrated in FIG. 7. The sealing device 70 is made from a piece of soft plastic (preferably polypropylene or polyethylene) or paper approximately 7 to 8 inches high and 4 to 5 inches wide. The plastic or paper piece is folded in half widthwise and the fold is perforated to tear when pushed against by a fill tube. The perforated seam 72 may or may not extend the entire length of the sealing device 70, although it will extend at least the length of the valve channel 16.

Figure 8:
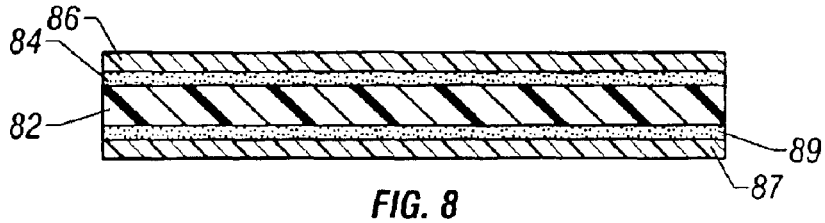
FIG. 8 is a cross sectional view of the sealing device shown in FIG. 7.

A cross-section of sealing device 70 is shown in FIG. 8. The sealing device 70 comprises a sheet of flexible material 82, a first adhesive surface layer 89 coating the back side of sheet 82 and a second adhesive surface layer 84 coating the top side of sheet 82. The adhesive layer 89 on the backside of sealing device 70 is optionally covered with a removable protective covering 87 and the adhesive layer 84 on the frontside of sealing device 70 is covered with a removable protective covering 86. If the adhesive layer 89 is a heat activated adhesive, it will not need to be protected with protective covering 87. The adherence of the adhesive layer 89 to the sides of the valve channel 16 is accomplished by a variety of means known in the art such as glue or a heat or sonically activated adhesive.

Figure 9:
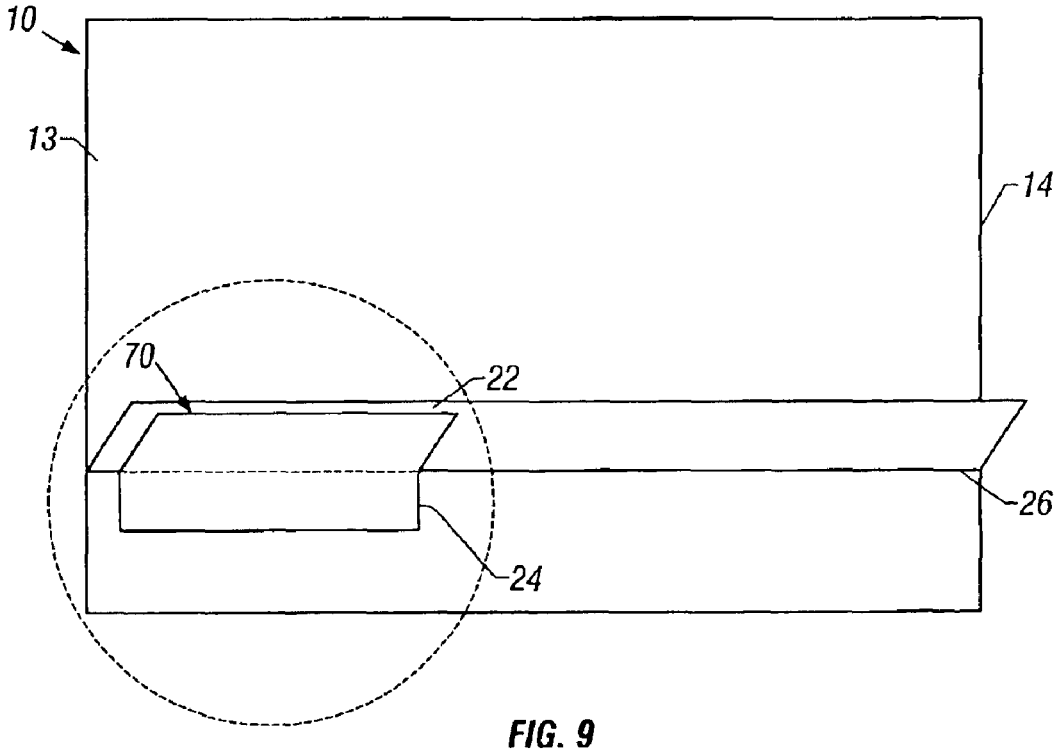
FIG. 9 illustrates the placement of the sealing device shown in FIG. 7 in the valve bag.
Figure 10:
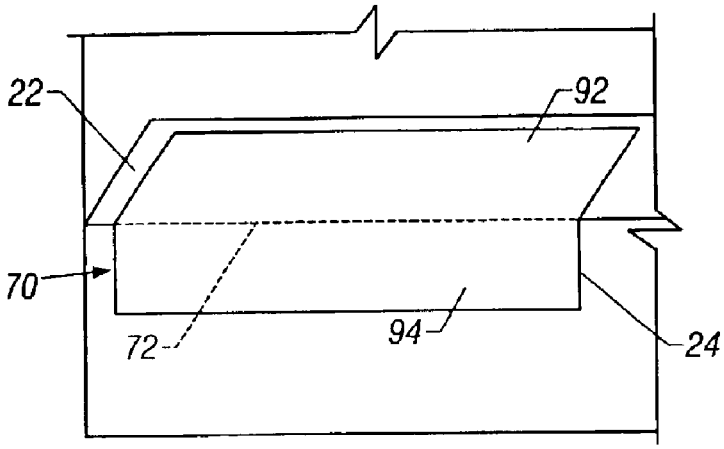
FIG. 10 is a view of the installation of the sealing device of FIG. 7 over the valve channel.

FIGS. 9 and 10 show sealing device 70 being installed in the valve bag 10. The sealing device 70 has two sections 92 and 94 separated by a perforated seam 72. FIG. 10 shows the sealing device 70 where the bottom side of section 92 is applied onto the bottom side of the overlapping front flap 22 and the bottom side of section 94 is applied to the top side of bottom flap 24. To protect the adhesive layer 84 that is on the upper surface of sections 92 and 94 before its application to the point of desired contact, removable strips of protective covering 86 are placed over the adhesive layer 84.

The sealing device 70 is installed as the cut plastic film is being formed into the valve bag 10. As the plastic film is folded over and heat sealed along seam 26, but before the short sides 13 and 14 are heat sealed, the overlapping front flap 22 and the bottom flap 24 can be separated and laid flat to permit the easy installation of the sealing device 70. As shown in FIG. 9, the sealing device 70 is aligned over the valve channel 16 and the bottom side of section 92 is adhered to the bottom side of the overlapping front flap 22 and the bottom side of section 94 is adhered to the top side of bottom flap 24. After the sealing device 70 has been installed, the overlapping front flap 22 is folded back over the bottom flap 24 and the short sides 13 and 14 of the valve bag 10 are heat sealed, which seals the top and bottom ends of the overlapping front flap 22 to the bottom flap 24.

Figure 11:
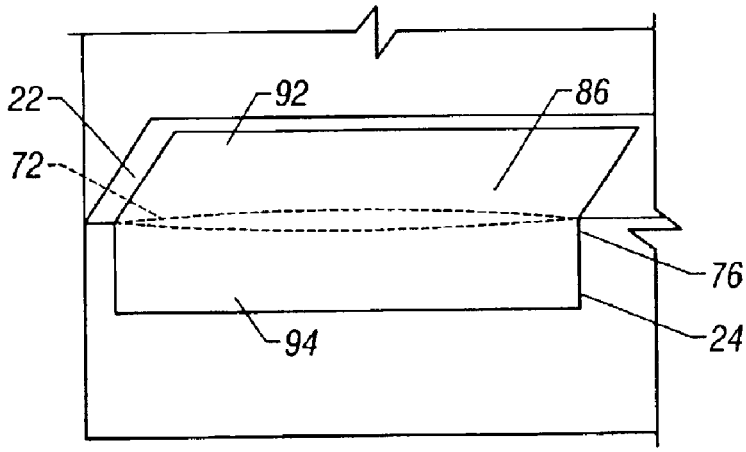
FIG. 11 illustrates the perforation of the perforated seam of the sealing device shown in FIG. 7.

When the sealing device 70 is installed in the valve channel 16 as described above, the topsides of section 92 and 94 will be aligned on top of each other. A single sheet of protective covering 86 having a perforated seam 72 in the middle the protective covering 86 protects the adhesive layer 84 on the top surface of sections 92 and 94 as shown in FIGS. 10 and 11. When the fill tube is pushed through the perforated seam 72 to begin filling the valve bag 10, the protective covering 86 will either split into two halves or it will stay adjoined at the lower end 76. Similarly to the protective sheet 52 shown in FIG. 5, the protective covering 86 may be designed to remain a single piece at the lower end 76 by extending the protective covering 86 beyond the length of the valve channel sufficiently to allow the entrance of the fill tube into the valve channel 16 without splitting the bottom of the protective covering 86. In addition, the lower end 76 may not be perforated to further encourage the protective covering 86 not to split at its bottom end 76 when the fill tube is pushed into the valve channel 16 to begin filling the valve bag 10.

Figure 12:
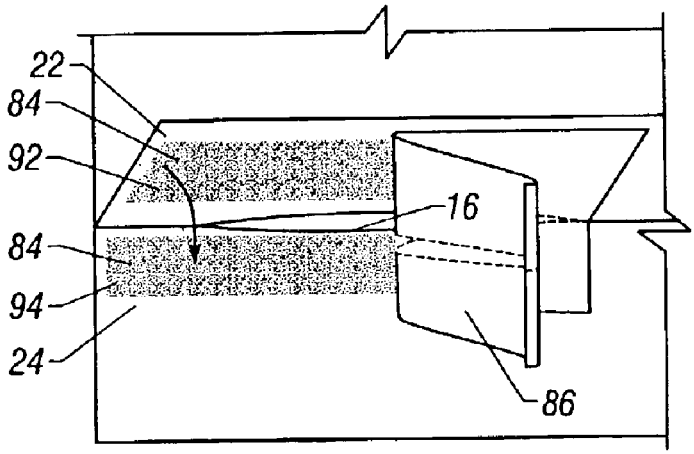
FIG. 12 shows the removal of the protective sheet to expose the adhesive layer of the sealing device and the direction that the sealing device is folded over to seal the valve channel.

Valve bags 10 manufactured with the sealing device 70 in place are easily filled and sealed on the typical assembly line. The valve bags 10 are filled through a filling tube inserted into the valve channel 16. The valve bag 10 is then flattened to remove excess air. Once the valve bag 10 has been filled and flattened, the top surface of the protective covering 86 is cleaned by blowing a stream of air over it, by brushing dust and particles off of it, or by vacuuming it off. When the protective covering 86 is clean, it is removed as shown in FIG. 12 from the top surface of sections 92 and 94. The top surface of sections 92 and 94 are then folded over each other and pressed together to form a consistent secure seal for the valve channel 16. The width of the sections 92 and 94, as well as the strips of protective covering 86, must be sufficient to ensure enough adhesive covered surface area is available to securely seal the valve channel 16, even if the outside sections do not exactly align after the valve bag 10 is filled.

EXAMPLE 3

Fold-over Flap Valve Channel Sealing Devices

Figure 13:
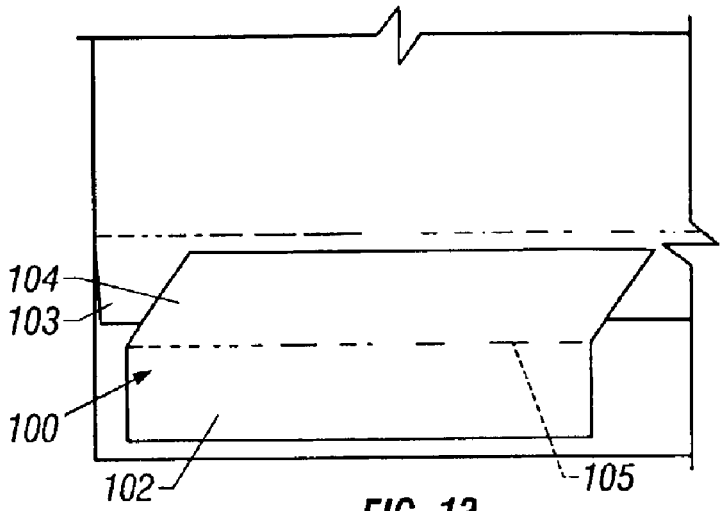
FIG. 13 FIG. 18 is a pan view of a valve bag with an end valve channel.
Figure 15:
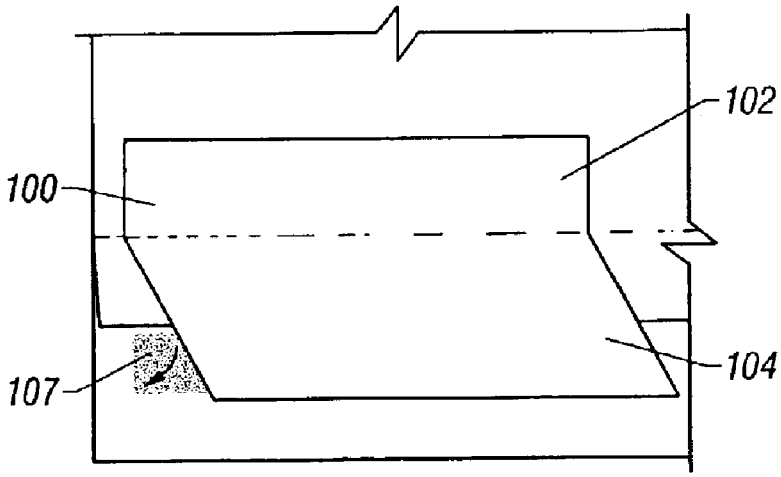
FIG. 15 illustrates an alternative placement of the sealing device shown in FIG. 13 on the valve bag.

Alternative embodiments of the sealing device are shown in FIGS. 13 and 15. The sealing device 100, shown in FIG. 13, is made from a piece of soft plastic (preferably polypropylene or polyethylene) or paper approximately 7 to 8 inches high and 4 to 5 inches wide. The plastic or paper piece is folded widthwise, generally one side 105 is made wider than the other side 102, and a fold 105 is created. The fold 105 is preferably minimally perforated to assist folding of the sealing device 100, but to resist tearing of the fold 105 during handling of the sealed valve bag 10. If the fold 105 is perforated, it is preferably not perforated the entire length of the sealing device 100.

Figure 14:
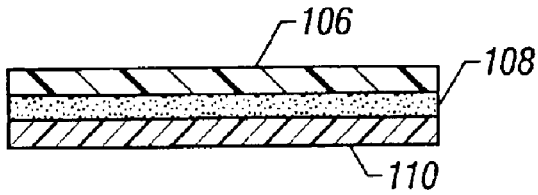
FIG. 14 is a cross sectional view of the sealing device shown in FIG. 13.

A cross-section of the side 104 of the sealing device. 100 is shown in FIG. 14. The side 104 comprises a sheet of flexible material 106, an adhesive surface layer 108 on the back side of sheet 106 and a removable protective covering 110 on the bottom side of adhesive surface layer 108.

FIG. 13 is a pan view of sealing device 100. The sealing device 100 has two sections, a smaller section 102 and a wider section 104, separated by the seam 105. The section 102 has an adhesive on its underside. FIG. 13 shows the sealing device 100 where the adhesive layer on the bottom of section 102 is applied onto the valve bag 10 on the side of the valve channel 16 across from the overlapping flap 103 of the valve channel. The adhesive on the backside of section 102 may be heat activated or any other type of adhesive known in the art.

The wider section 104 is wide enough to pass over the overlapping flap 103 and be secured to the valve bag 10 on the opposite side of the overlapping flap 103 from the smaller section 102. To protect the adhesive layer 108 that is on the under side of the wider section 104 before its application to the point of desired contact, a removable strip of protective covering 110 is placed over the adhesive layer 108.

The sealing device 100 is installed after the valve bag 10 has been formed. First, the adhesive on the underside of section 102 is adhered to valve bag 10 such that it is aligned with the valve channel 16 and on the opposite side of the valve bag 10 from the overlapping flap 103.

Once the sealing device 100 is installed on the valve bag, the valve bag 10 is ready for filling. The fill tube is inserted into the valve channel 16 to begin filling the valve bag 10. Once the valve bag 10 has been filled and flattened, the valve bag channel 16 is closed and the valve bag surface around the valve bag channel is blown, wiped or vacuumed to remove any dust or particulate matter. Once the surfaces have been cleaned the protective sheet 110 on the bottom side of the section 104 is removed to expose the adhesive layer 108. The adhesive layer 108 is pressed against the valve bag 10 to secure the section 104 to the valve bag on the opposite side of the valve channel 16 from where the section 102 is attached to the valve bag 10.

The sealing device 100 can be installed in either direction over the valve channel 16 as shown in FIGS. 13 and 15. The width of the sections 102 and 104, as well as the strips of adhesive 108 and protective covering 110, must be sufficient to ensure enough adhesive covered surface area is available to securely seal the valve channel 16, even if the outside sections do not exactly align after the valve bag 10 is filled.

Alternatively, another adhesive strip 107, protected by a protective sheet, may be applied to the opposite side of the valve bag 10 from where the smaller section 102 is applied to the valve bag 10. The adhesive strip 107 is aligned with valve channel 16. Once the valve bag is filled and the protective surfaces covering the inner adhesive 108 of section 104 and the adhesive strips 107 are cleaned, the protective sheets are removed, as shown in FIG. 15, and the adhesive layer 108 is folded over the closed valve channel 16 and adhered to the adhesive strip 107 to securely seal the valve channel.

EXAMPLE 4

Top-Bottom Fold-Over Sealing Devices

Figure 16:
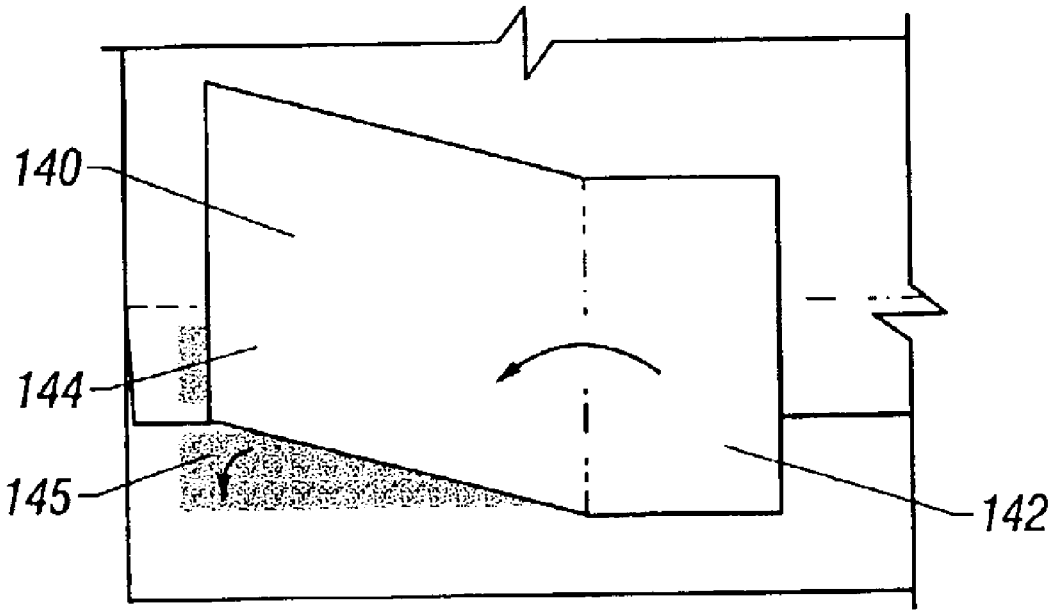
FIG. 16 is a pan view of the installation of yet another embodiment of the sealing device of the present invention on the valve bag.
Figure 17:
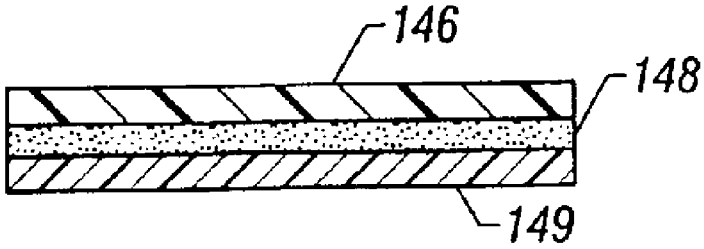
FIG. 17 is a cross sectional view of the longer section of the sealing device shown in FIG. 16.

Another embodiment of the sealing device is shown in FIG. 16. The sealing device 140 is typically much longer than the other embodiments of the sealing device described above. Sealing device 140 is very similar in construction to the sealing device 100. The sealing device 140 is a single long piece that has a fold dividing sealing device 140 into two sections, a smaller section 142 and a longer section 144. The smaller section 142 has an adhesive on its underside, but may or may not be covered by a protective sheet; whereas the longer section 144 will have a protective sheet covering its adhesive layer. A cross-section of the longer section 144 is shown in FIG. 17, the section 144 comprises a plastic or paper sheet 146, an adhesive layer 148 and a protective covering 149.

The smaller section 142 is attached to the valve bag 10 below the valve channel 16 by adhering it to the valve bag 10 before the valve bag 10 is filled. Once the valve bag 10 is filled and flattened, the valve channel 16 is folded closed, the surface of the valve bag 10 around the valve channel 16 is cleaned of dust and debris, the longer section 144 of the sealing device 140 is folded over the length of the valve channel, its protective covering 149 removed and the adhesive layer 148 on the under side of the longer section 144 is secured along the surface of the closed valve channel to ensure that it is securely closed. As with the sealing device 100, an alternative adhesive strip 145 may be used to further ensure a consistent secure seal on the valve channel 16.

EXAMPLE 5

Sealing Device for Sealing End Valve Tube

Figure 19:
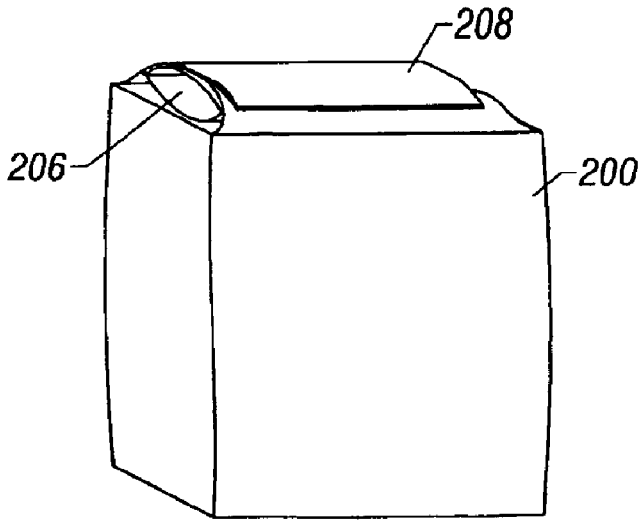
FIG. 19 is a pan view of the valve bag of FIG. 18 with an end valve channel.

FIGS. 18 and 19 show a typical valve bag 200 having an end valve channel or tube 206. During assembly of the valve bag 200, the short end pieces 204 and 203 are folded inward and the bottom side of the valve tube 206 is placed on top of the end piece 204. The long end pieces 202 and 207 are then folded over the short end pieces 204 and 203 and the valve tube 206 as illustrated in FIGS. 18 and 19. The folded end pieces and valve tube 206 are held in place by the overlay 208. One end of the valve tube 206 is open to the interior of the valve bag 200 and the other end is open to the exterior of the bag so that a fill tube can be inserted to fill the bag.

Figure 20:
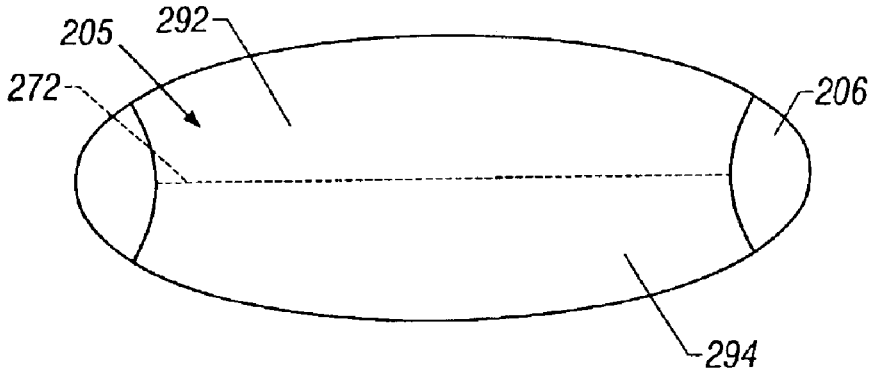
FIG. 20 is a frontal view of the valve channel of the valve bag of FIG. 18 with a sealing device of the present invention installed inside the opening to the valve channel.

One embodiment of the sealing device 205, shown in FIG. 20, is constructed similar to sealing device 70, except that it is preferably annular in construction to fit snuggly within the valve tube 206.

Figure 21:
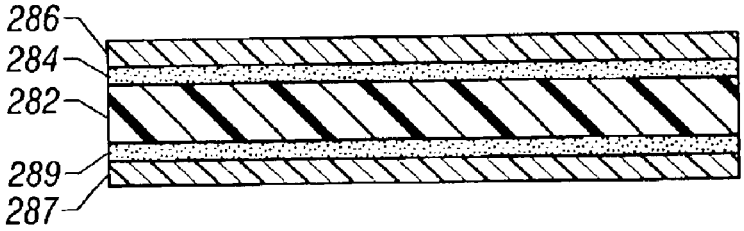
FIG. 21 is a longitudinal cross sectional view of the sealing device shown in FIG. 20.

The sealing device 205 is made from a piece of soft plastic (preferably polypropylene or polyethylene) or paper that is folded in half lengthwise and the fold is perforated to tear when pushed against by a fill tube. A cross-section of sealing device 205 is shown in FIG. 21. The sealing device 205 comprises a soft plastic or paper sheet 282, an adhesive surface layer 289 on the back side of sheet 282 and an adhesive surface layer 284 on the top side of sheet 282. The adhesive layer 289 on the backside of sealing device 205 is optionally covered with a removable protective covering 287 and the adhesive layer 284 on the frontside of sealing device 205 is covered with a removable protective covering 286. If the adhesive layer 289 is a heat activated adhesive, it will not need to be protected with protective covering 287. The adherence of the adhesive layer 289 to the sides of the valve tube 206 is accomplished by a variety of means known in the art such as glue or a heat or sonically activated adhesive.

FIG. 20 shows sealing device 205 installed in the valve tube 206 of valve bag 200. The sealing device 205 has two sections 292 and 294 separated by a perforated seam 272. FIG. 20 shows the sealing device 205 where the bottom side of section 292 is applied along the surface of the top side of the valve tube 206 and the bottom side of section 294 is applied along the surface of the bottom side of the valve tube 206. To protect the adhesive layer 284 that is on the upper surface of sections 292 and 294 before its application to the point of desired contact, a removable protective covering 286 are placed over the adhesive layer 284.

The sealing device 205 is installed before the valve bag 200 is filled. Once the sealing device 205 is installed in the valve tube 206, the topsides of section 292 and 294 will be aligned on top of each other. A single sheet of protective covering 286 having a perforated seam 272 in the middle the protective covering 286 protects the adhesive layer 284 on the top surface of sections 292 and 294. When the fill tube is pushed through the perforated seam 272 to begin filling the valve bag 200, the protective covering 286 will basically split into two halves. Similarly to the protective sheet 52 shown in FIG. 5, the protective covering 286 may be designed to remain a single piece at its lower end by extending the protective covering 286 beyond the length of the valve tube 206 so that it can be more easily removed.

Figure 27:
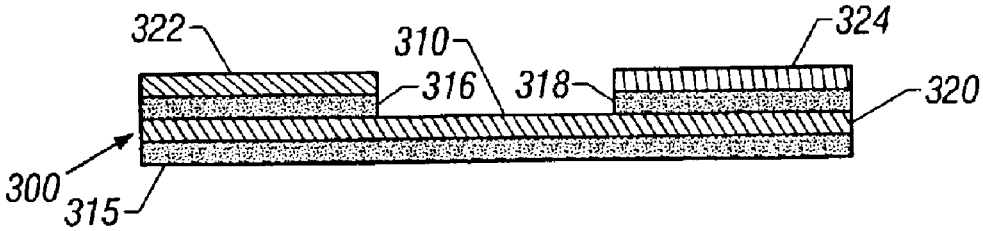
FIG. 27 is a longitudinal cross sectional view of the sealing device shown in FIG. 26.

Alternatively the sealing device may be constructed of two sections of material, each section similar the section 292 of the sealing device 205. In this embodiment the two sections of the sealing device may be separate pieces or may be constructed as a single piece 300 such as shown in FIG. 27 in which a central section 310 separates two end sections 302 and 304. A cross-section of sealing device 300 is shown in FIG. 28. The sealing device 300 comprises a soft plastic or paper sheet 320 with an adhesive layer 315 on its underside. The adhesive layer 315 may or may not be covered with a protective sheet. The topside of the layer 320, corresponding to the two end sections 302 and 304, has adhesive layers 316 and 318 respectively. These two adhesive layers 302 and 304 are covered with protective sheets 322 and 324 respectively.

The sealing device 300 is installed into the valve tube 206 as it is being made. The sealing device is secured by adhesive to the inner surface of the valve tube 206 while it is a linear sheet before it is rolled into a tube. The sealing device 300 is secured to the valve tube 206 such that when the valve tube 206 is in a tubular configuration the end sections 302 and 304 are aligned so that one is on top of the other. The protective sheets 322 and 324 may be extended in length to ease their removal after the valve bag has been filled.

Valve bags 200 with the sealing device 205 or 300 in place are easily filled and sealed on the typical assembly line. The valve bags 200 are filled through a filling tube inserted into the valve tube 206. Once the valve bag 200 has been filled, the top surface of the protective coverings 286 or 322 and 324 are cleaned by blowing a stream of air over them, by brushing dust and particles off of them, or by vacuuming them off. When the protective coverings 286 or 322 and 324 are clean, they are removed from the top surface of sections 292 and 294 or 302 and 304. The top surface of sections 292 and 294 or 302 and 304 are then folded over each other and pressed together to form a consistent secure seal for the valve tube 206. The width of the sections 292 and 294 or 302 and 304, as well as the strips of protective coverings 286 or 322 and 324, must be sufficient to ensure enough clean adhesive covered surface area is available to securely seal the valve tube 206, even if sections 292 and 294 or 302 and 304 do not exactly align after the valve bag 200 is filled.

EXAMPLE 6

Fold Over Valve Tube Sealing Device

Figure 22:
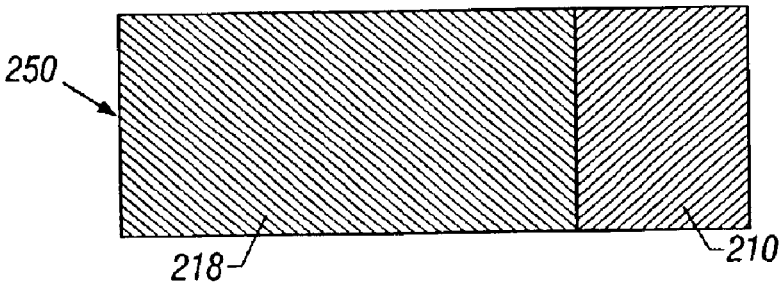
FIG. 22 is a top view of another embodiment of the sealing device of the present invention.

Another embodiment of sealing device 250 is designed to seal the valve tube 206. The sealing device 250, shown in FIG. 22 is made from a piece of soft plastic (preferably polypropylene or polyethylene) or paper.

Figure 23:
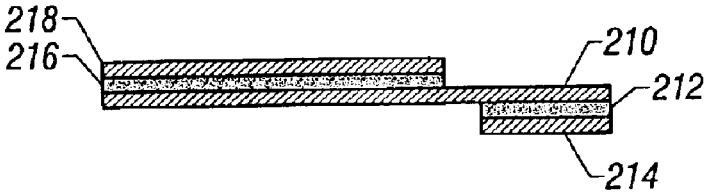
FIG. 23 is a longitudinal cross sectional view of the sealing device shown in FIG. 22.

A cross-section of sealing device 250 is shown in FIG. 23. The sealing device 250 comprises a soft plastic or paper layer 210, an adhesive layer 212 on a portion of one end of the back side of layer 210 and an optional removable protective covering 214 on the bottom side of adhesive surface layer 212. The portion of the layer 210 that is directly above the adhesive layer 212 has a smooth non-adhesive surface. At the opposite end of layer 210, an adhesive layer 216 covers a portion of the top side of layer 210 and a protective sheet 218 covers the adhesive layer 216. The adhesive layers 216 and 214 cover opposite ends of the layer 210 on opposed sides. Generally, the adhesive layers 216 and 214 will not cover the same section of the layer 210 and there may be a section of the layer 210 where no adhesive is applied to the top surface or the bottom surface of the layer 210 as illustrated in FIG. 23.

Figure 24:
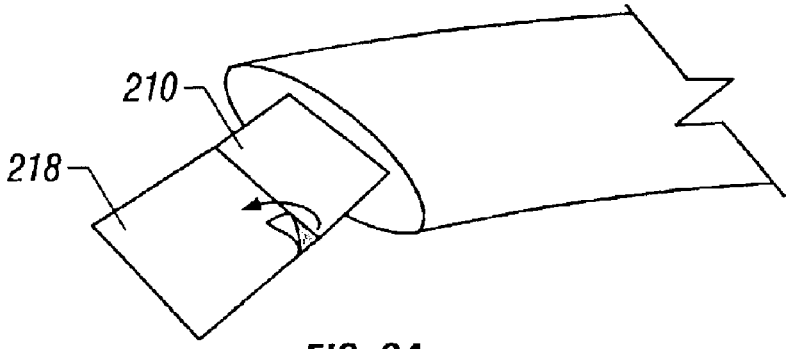
FIG. 24 illustrates the placement of the sealing device shown in FIG. 22 into the valve channel.
Figure 25:
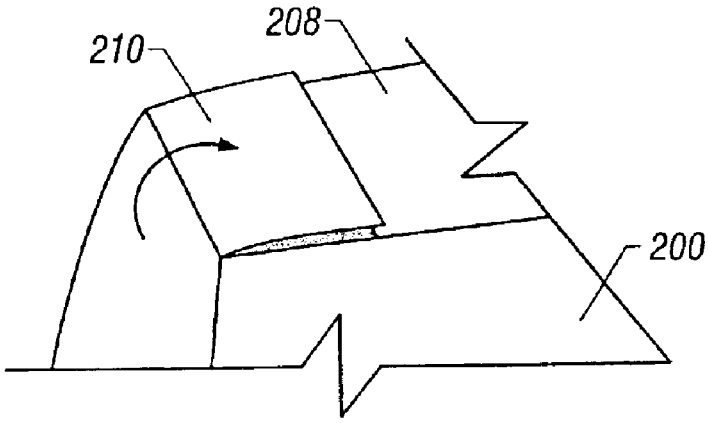
FIG. 25 illustrates the sealing of the valve channel of an end valve bag with the sealing device of FIG. 22.
Figure 26:
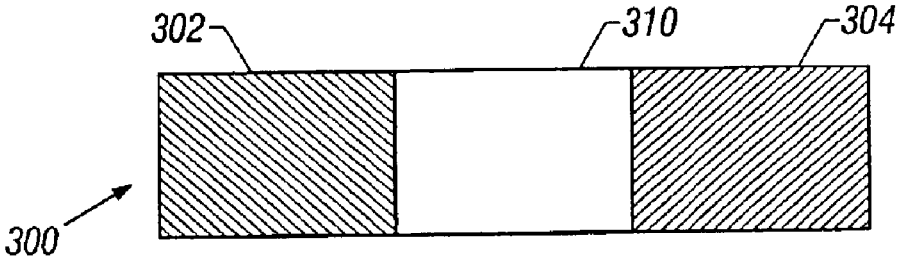
FIG. 26 is a top view of another embodiment of the sealing device of the present invention.

The sealing device 250 is generally installed after the valve bag 200 has been made as shown in FIGS. 24 and 25. The adhesive layer 212 on the bottom side of the layer 210 is applied to the interior lower surface of the valve channel 206 to securely attach the sealing device to the valve channel 206. Once the valve bag 200 has been filled, the protective sheet 218 is removed to expose the adhesive layer 216. Then the sealing device 250 is folded over the overlay piece 208 and adhered to upper side of the overlay 208 to securely close the end of the valve channel 206 that opens to the outside. A partial cross-section of the upper end of valve bag 200 securely closed with sealing device 250 is shown in FIG. 26.

Alternatively, another adhesive strip, protected by a protective sheet, may be applied to the end of the upper side of the overlay 208 where the sealing device 250 is folded over. The adhesive strip is aligned with valve channel 206. Once the valve bag is filled and the protective surfaces covering the adhesive covering the overlay 208 and the adhesive layer 216 of the sealing device 250 are removed, the adhesive layer 216 is folded over the closed valve channel 206 and adhered to the adhesive strip covering that end of the overlay 108 to securely seal the valve channel.

The sealing device 250 may also be made a part of the valve bag 200. In that case, the end of sealing device 250 opposite the adhesive layer 216 would be heat sealed or otherwise secured between the side 204 and the bottom outside surface of the valve channel 206. The end of the sealing device 250 having the adhesive layer 216 and the protective sheet 218 would extend outward from the valve bag 200. Once the bag had been filled and flattened, the outwardly extending end of the sealing device 250 would be folded over the overlay 208, the protective sheet 218 removed, and the adhesive layer 216 secured to the upper side of the overlay 208.

Although the present invention and its advantages have been described in detail, it should be understood that various changes, substitutions, and alterations can be made to the described process, the materials used and the sealing system without departing from the spirit and scope of the invention as defined by the appended claims.

What is claimed is:

1. A valve channel seal, in combination with a valve bag comprising a valve bag having a valve channel at a seam of the bag:

a sheet of flexible material having a first section and a second section having a perforated seam located between the first and second section, wherein the first section having a back surface by which it is secured to the first side of the valve channel of the valve bag and the second section having a back surface by which it is secured to a second side of the valve channel and the perforated seam is positioned over an opening in the valve channel;

an second adhesive covering the entire length of an upper surface of at least one section of the sheet; and a removable upper protective sheet covering the adhesive.

2. The valve channel seal combination of claim 1, wherein a portion of the protective sheet is perforated.

3. The valve channel seal of combination claim 1, wherein the adhesive overlies the length of the first and second sections.

4. The valve channel seal combination of claim 1, wherein the first section has a width substantially similar to a width of the first side of the valve channel.

5. The valve channel seal combination of claim 1, wherein the first and second sections are substantially equal in surface area.

6. The valve channel seal combination of claim 1, wherein the sealing device is rectangular in shape.

7. The valve channel seal combination of claim 1, wherein the first section is adjacent the second section.

8. The valve channel seal combination of claim 1, wherein the sheet further comprises a third section located between the first and second section.

9. The valve channel seal combination of claim 1, wherein the first section is larger than the second section.

10. A valve channel seal in combination with a valve bag comprising a valve bag having a valve channel at a seam of the bage:

a sheet of flexible material having a first section and a second section having a perforated seam located between the first and second section, wherein a first under surface of the first section is secured to a first side of the valve channel of the valve bag and a second under surface of the second section is secured to a second side of the valve channel and the perforated seam is positioned over an opening in the valve channel, the sheet is folded over itself at the perforated seam such that a first upper surface of the first section faces a second upper surface of the second section;

an adhesive covering the entire length of the first and second upper surface of the first and second section of the sheet; and a removable upper protective sheet covering the adhesive.

11. A valve channel seal in combination with a valve bag comprising (a) a valve bag having a vale channel at a seam of the bag:

(b) a four sectioned sheet of flexible material having a proximal end and a distal end, the sheet comprising (i) a primary exterior section having a first side and a second side, wherein the first side of the primary exterior section is the distal end of the four sectioned sheet, (ii) a secondary exterior section having a first side and a second side, wherein the second side of the secondary exterior section in proximal end of the four sectioned sheet, (iii) a primary interior section having a first side and a second side, wherein the second side of the primary interior section adjoins the second side of the primary exterior section, and (iv) a secondary interior section having a afirst side and a second side, wherein the first side of the secondary interior section adjoins the first side of secondary exterior section and the second side of the secondary interior section is joined to the first side of the primary interior section, wherein the primary and secondary interior sections are folded inward and the second side of the primary exterior section is aligned with the first side of the secondary exterior section;

(c) a first adhesive coating the entire length of a back surface of the primary and secondary interior sections, such that when the primary and secondary sections are folded inward a front surface of the primary interior section faces a front surface of the secondary interior section and the first adhesive coating of the primary interior section and the first adhesive coating of the secondary interior section face away from each other;

(d) the primary and secondary interior sections are, respectively, adhered to a first side and a second side of the valve channel of the valve bag;

(e) a second adhesive coating the entire length of an outer surface of the primary and secondary exterior sections; and (f) a removable upper protective sheet covering the second adhesive coating on the outer surface of the primary and secondary exterior sections, wherein placement of the protective sheet secures the second side of the primary exterior section adjacent to the first side of the secondary exterior section.

12. The valve channel seal combination of claim 11, wherein a portion of the upper protective sheet is perforated.

* * * * *